US006030320A

United States Patent [19]

Stearns et al.

[11] Patent Number: 6,030,320

[45] Date of Patent: Feb. 29, 2000

[54] COLLAPSIBLE EXERCISE APPARATUS

[76] Inventors: Kenneth W. Stearns, 8009 Cedel, Houston, Tex. 77055; Joseph D. Maresh, 19919 White Cloud Cir., West Linn, Oreg. 97068

[21] Appl. No.: 09/005,750

[22] Filed: Jan. 12, 1998

[51] Int. Cl.[7] ..... A63B 69/16; A63B 22/04

[52] U.S. Cl. ..... 482/57; 482/51; 482/70

[58] Field of Search ..... 482/51, 52, 57, 482/62, 70, 79–80; 280/267

[56] References Cited

U.S. PATENT DOCUMENTS 5,423,729 6/1995 Eschebach ..... 482/70
5,630,774 5/1997 Geschwender ..... 482/57
5,709,633 1/1998 Sokol ..... 482/62
5,746,683 5/1998 Lee ..... 482/51
5,830,114 11/1998 Halfen et al. ..... 482/70
5,860,895 1/1999 Lee ..... 482/51

*Primary Examiner*—Stephen R. Crow

[57] ABSTRACT

An exercise apparatus has a linkage assembly which links rotation of a crank to generally elliptical movement of a force receiving member. The apparatus may be folded into a storage configuration having an overall height which is less than the greater of the diameter of the crank and the diameter of a flywheel which rotates together with the crank.

21 Claims, 4 Drawing Sheets

100
189
189
180
180
188
Y
176
134
X
140
142
170
146
177
187
121
136
144
132
178
122
125
128
112
115
111
Y

COLLAPSIBLE EXERCISE APPARATUS

FIELD OF THE INVENTION

The present invention relates to exercise methods and apparatus and specifically, to exercise equipment which uses a crank and flywheel combination to provide smooth exercise motion but nonetheless collapses into a relatively flat storage configuration.

BACKGROUND OF THE INVENTION

Exercise equipment has been designed to facilitate a variety of exercise motions. For example, treadmills allow a person to walk or run in place; stepper machines allow a person to climb in place; bicycle machines allow a person to pedal in place; and other machines allow a person to skate and/or stride in place. Many of these prior art machines include a flywheel to provide a relatively smooth exercise motion.

Yet another type of exercise equipment has been designed to facilitate relatively more complicated exercise motions and/or to better simulate actual striding motion. Such equipment typically links a relatively simple motion (i.e. circular) to a relatively more complex motion (i.e. elliptical). Examples of such equipment are disclosed in U.S. Pat. Nos. 4,185,622 to Swenson; 5,242,343 to Miller; and 5,529,555 to Rodgers, Jr. These devices similarly include a flywheel in order to enhance their performance.

A disadvantage of many exercise machines, including those disclosed in the above-identified references, is that they are relatively bulky. Some efforts have been undertaken to address this shortcoming in the art, as evidenced by U.S. Pat. Nos. 5,352,169 to Eschenbach; 5,423,729 to Eschenbach; and 5,529,554 to Eschenbach, for example. Although relatively more collapsible, the machines disclosed in these patents have no flywheel and thus, have sacrificed performance for more convenient storage. In other words, a need remains for an exercise apparatus which includes a flywheel for high performance exercise yet nonetheless may be collapsed into a relatively compact storage configuration.

SUMMARY OF THE INVENTION

The present invention provides methods and apparatus to transform a high performance exercise apparatus from a relatively bulky operative configuration to a relatively compact storage configuration. Unlike the devices disclosed in the Eschenbach references, the present invention includes a flywheel and yet, still collapses into a storage configuration comparable in overall height to the collapsible Eschenbach machines.

In an exemplary embodiment of the present invention, a support is rotatably mounted on a frame, and both a crank (or cranks) and a "stepped-up" flywheel are rotatably mounted on the support. The support selectively rotates about a first axis relative to the frame, and the crank(s) and the flywheel rotate about respective axes which extend perpendicular to the first axis. When the apparatus is in its operative configuration, the support is substantially vertical, the crank and flywheel axes are substantially horizontal, and foot supporting members are connected to opposite ends of the crank(s).

When the apparatus is in its storage configuration, the support is substantially horizontal, and the crank and flywheel axes are substantially vertical. In other words, the flywheel is moved onto its side for storage purposes. In this configuration, the foot supporting members are disconnected from the crank(s). Additional features and advantages of the present invention may become more apparent from the detailed description that follows.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
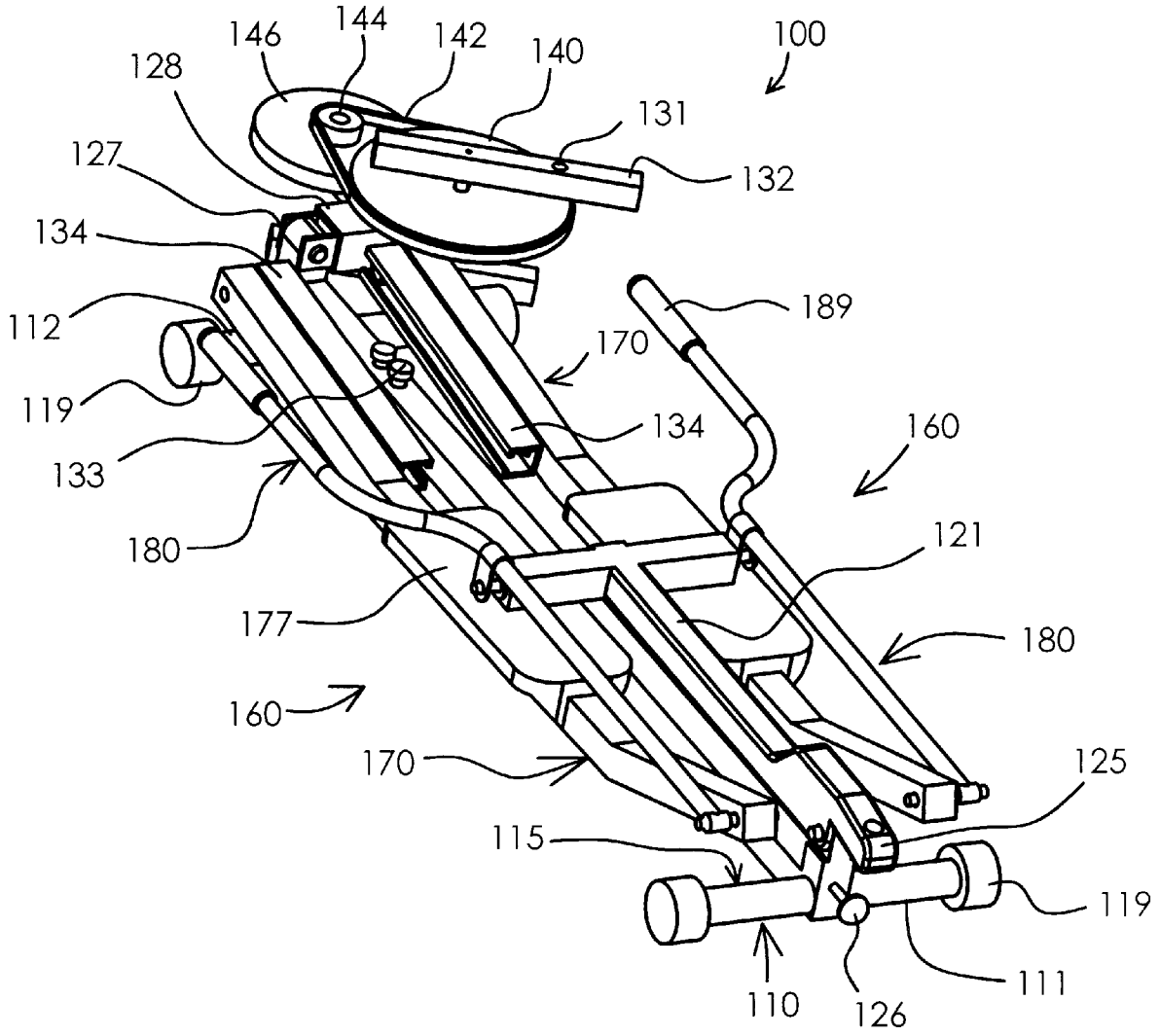
FIG. 1 is a perspective view of an exercise apparatus constructed according to the principles of the present invention and disposed in a storage configuration.

An exercise apparatus constructed according to the principles of the present invention is designated as 100 in FIGS. 1–4. The exercise apparatus 100 generally includes a frame 110, right and left cranks rotatably mounted on opposite sides of the frame 110, and right and left linkage assemblies 160 movably interconnected between the frame 110 and respective cranks. Generally speaking, the linkage assemblies 160 move relative to the frame 110 in a manner that links rotation of respective cranks to generally elliptical motion of respective force receiving members. The term "elliptical motion" is intended in a broad sense to describe a closed path of motion having a relatively longer first axis and a relatively shorter second axis (which is perpendicular to the first axis).

Although the present invention is described with reference to a particular elliptical motion exercise machine, those skilled in the art will recognize that the present invention is not limited to any particular machine, but rather, is applicable to all sorts of exercise machines, including other elliptical motion exercise machines and other types or categories of exercise machines. Some such machines are disclosed in U.S. Pat. Nos. 5,242,343 to Miller; 5,423,729 to Eschenbach; 5,529,555 to Rodgers, Jr.; and U.S. patent appl'n Ser. No. 08/953,308, filed on Oct. 17, 1997, (which application is owned by the owner of the present invention). These patents and this patent application are incorporated herein by reference.

The frame 110 generally includes a base 115 which extends from a first or forward end 111 to a second or rearward end 112. At each of the ends 111 and 112, a transverse member extends in opposite directions away from each side of the base 115 to stabilize the apparatus 100 relative to a horizontal floor surface 99. Caps 119 are mounted on opposite ends of the transverse members, and the rearward caps function as wheels when the apparatus 100 is not supporting a person's weight.

The apparatus 100 is generally symmetrical about a vertical plane extending lengthwise through the base 115 (perpendicular to the transverse members), the only exception being the relative orientation of certain parts on opposite sides of the plane of symmetry. In the embodiment 100, the "right-hand" parts are one hundred and eighty degrees out of phase relative to the "left-hand" counter-parts. Thus, when reference is made to one or more parts on only one side of the apparatus, it is to be understood that corresponding part(s) are disposed on the opposite side of the apparatus 100. Those skilled in the art will also recognize that the portions of the frame 110 which are intersected by the plane of symmetry exist individually and thus, do not have any "opposite side" counterparts.

A first support 121 is pivotally mounted to a forward trunnion on the base 115, just above the forward transverse member. The support 121 selectively pivots relative to the base 115 about an axis extending perpendicular to the drawing sheets of FIGS. 2 and 4. A bar or extension 125 is mounted on the lower end of the support 121 to engage or parallel a forward face of the trunnion when the support 121 is pivoted to a substantially vertical position. A hole in the extension 125 aligns with a hole in the trunnion to receive a fastener 126. The fastener 126 may be secured in place by a ball detent, threads, or any other suitable means known in the art.

Figure 2:
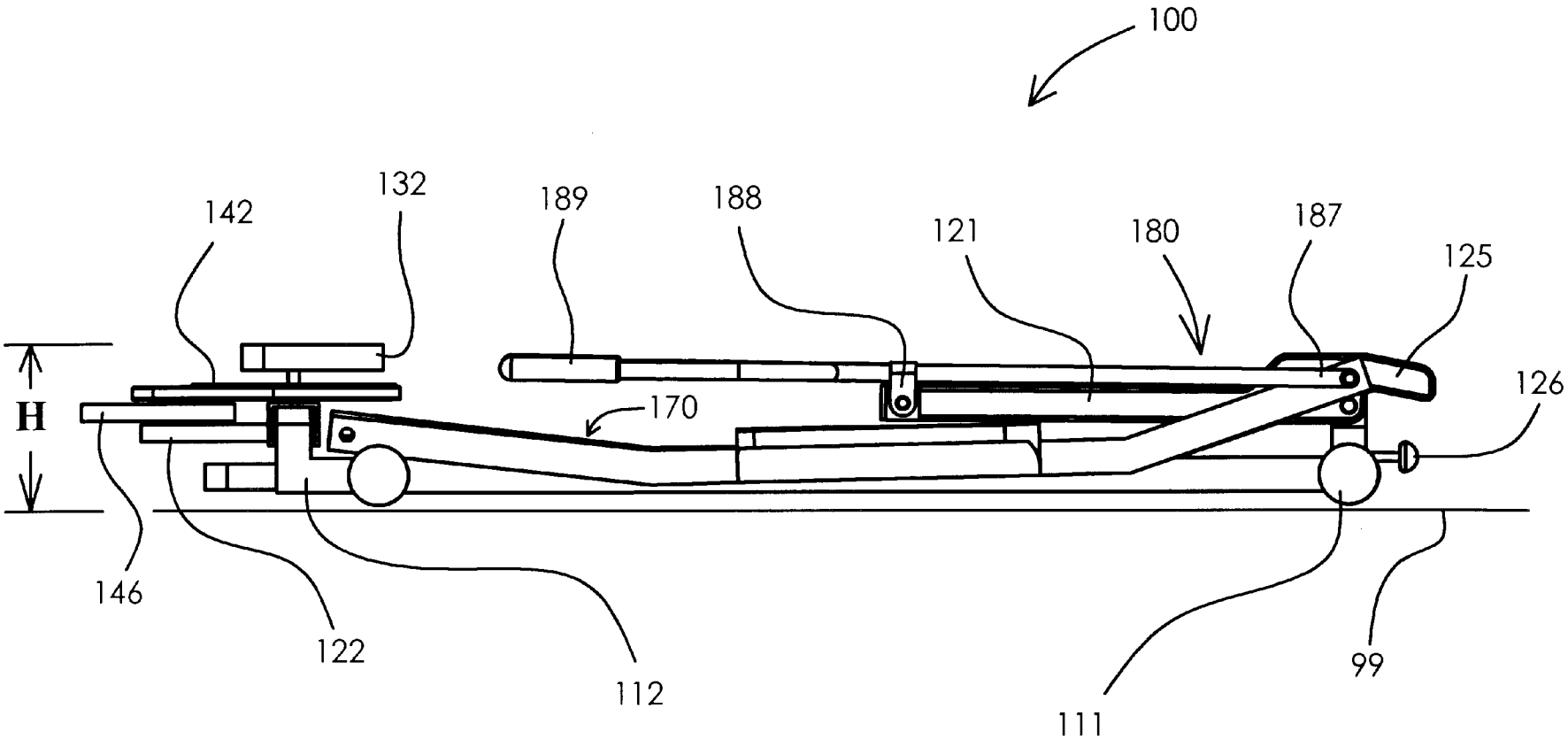
FIG. 2 is a side view of the exercise apparatus of FIG. 1.

When the fastener 126 is removed, and the support 121 is pivoted to a substantially horizontal position (as shown in FIGS. 1–2), the extension 125 protrudes forward, and the forward face of the trunnion is exposed. The fastener 126 is then inserted directly into the trunnion, and the extension 126 provides a convenient handle or grip for lifting of the front end 111 of the apparatus 100.

A second support 122 is pivotally mounted to a rearward trunnion on the base 115. The support 122 selectively pivots relative to the base 115 about an axis extending parallel to the drawing sheets of FIGS. 2 and 4 and generally parallel to the longitudinal axis of the base 115. Opposing flanges 127 on the lower end of the support 122 flank opposite sides of the trunnion when the support 122 is pivoted to a substantially vertical position. A sleeve 128 is slidably mounted on the support 122, and adjacent portions of the support 122 and the trunnion cooperate to define a substantially continuous post sized and configured to receive the sleeve 128. By surrounding these adjacent portions of the support 122 and the trunnion, the sleeve 128 maintains the support 122 in a substantially vertical orientation. When the sleeve 128 is moved upward beyond the trunnion, the support 122 is pivotal to either side of the apparatus 100 (in the absence of any other connections). Those skilled in the art will recognize numerous alternatives to the sleeve arrangement, including a pin arrangement similar to that provided for the front support 121.

On each side of the apparatus 100, a crank is rotatably mounted to the rear support 122 via a common shaft. More specifically, on each side of the apparatus 100, a rod 132 is mounted on an end of the crank shaft, and a sleeve 134 is slidably mounted on the rod 132. A bolt 133 is inserted through a spring washer and any of several holes 136 in the sleeve 134 and then threaded into a hole 131 in the rod 132 to selectively secure the sleeve 134 relative to the rod 132.

A relatively large diameter pulley 140 is rigidly mounted to the crank shaft and rotates together with the cranks relative to the support 122. A closed loop or belt 142 connects the large pulley 140 to a relatively small diameter pulley 144 which rotates together with a flywheel 146 relative to the support 122. The resulting "stepped-up" flywheel 146 rotates faster than the cranks. A drag strap (not shown) is disposed about the flywheel 146 in a manner known in the art to provide resistance to rotation of the flywheel 146 and the cranks. Those skilled in the art will recognize that other "resistance devices" may be added to or substituted for the flywheel arrangement to alter inertia and/or resistance to exercise movement.

A distal end of each sleeve 134 is rotatably connected to a rearward portion 176 of a respective foot supporting member 170. Each of these points of connection, designated as Y in FIG. 4, cooperates with the crank axis, designated as X in FIG. 4, to define an effective crank radius (as measured linearly therebetween). The effective crank radius of each crank may be adjusted by removing the bolt 133, moving the sleeve 134 relative to the rod 132 to align a different hole 136 with the hole 131 in the rod 132, and threading the bolt 133 through the newly aligned holes. Although this particular embodiment 100 has an adjustable crank radius, those skilled in the art will recognize that the present invention is also applicable to exercise machines having a fixed crank radius.

An intermediate portion 177 of each foot supporting link 170 is sized and configured to support a person's foot. An opposite, forward portion 178 of each foot supporting link 170 is rotatably connected to a lower portion 187 of a respective rocker link 180. An intermediate portion 188 of each rocker link 180 is rotatably mounted relative to the forward support 121. An upper portion 189 of each rocker link 180 is sized and configured for grasping by a person standing on the foot supporting links 170. The links 170 and 180 cooperate to define respective linkage assemblies 160 interconnected between the cranks and the frame 110. Those skilled in the art will recognize that other means exist for constraining the forward portions 178 of the foot supporting links 170 to move in reciprocating fashion.

Figure 3:
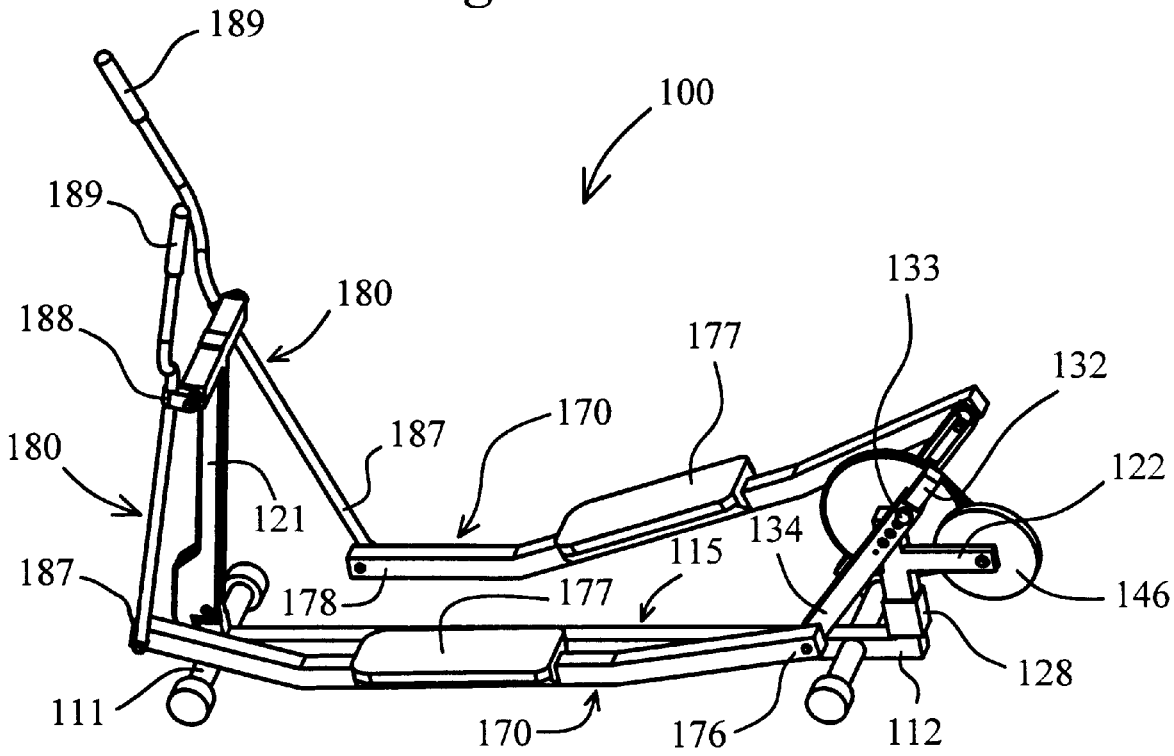
FIG. 3 is a perspective view of the exercise apparatus of FIG. 1 but disposed in an operative configuration.
Figure 4:
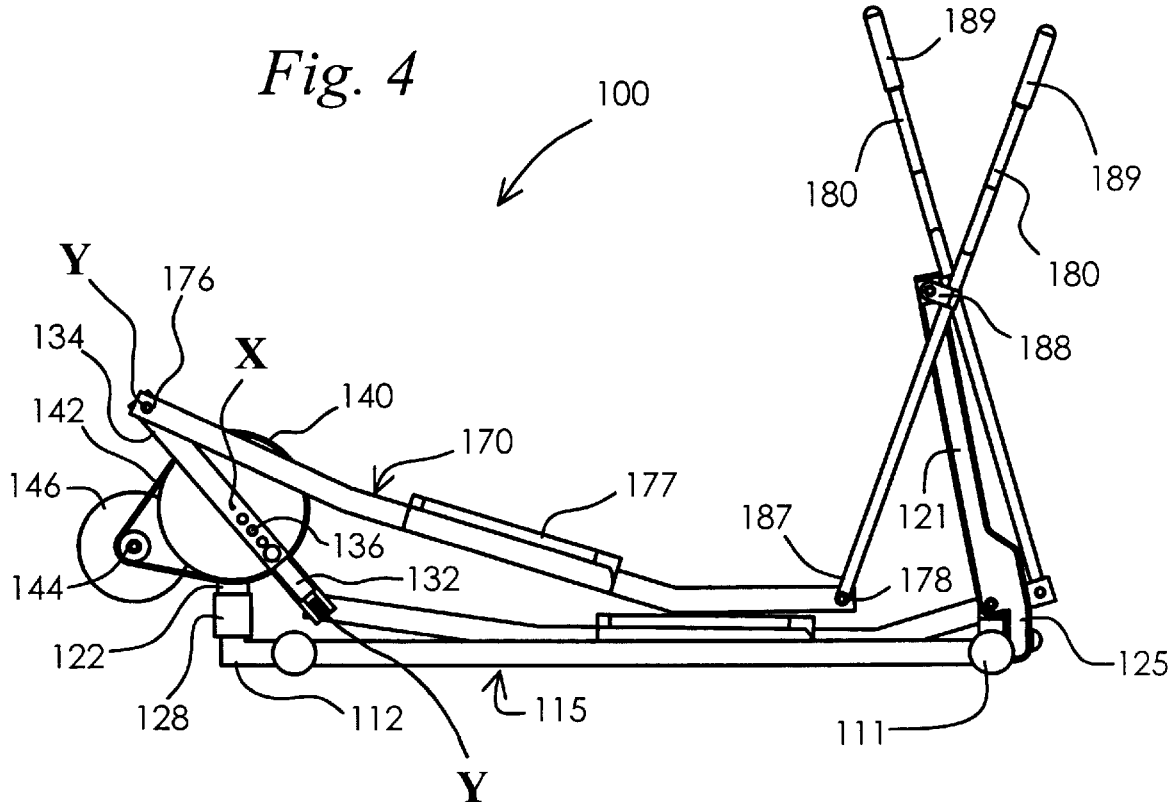
FIG. 4 is a side view of the exercise apparatus of FIG. 3.

In order to transform the apparatus 100 from the operative configuration shown in FIGS. 3–4 to the storage configuration shown in FIGS. 1–2, the bolts 133 and the sleeves 134 are removed or disconnected from the rods 132; the sleeve 128 is moved upward along the rearward support 122, and the support 122 is pivoted laterally to a generally horizontal orientation. The bolts 133 are stored in holes provided in the base 115. Also, the fastener 126 is removed from the forward trunnion, and the forward support 121 is pivoted rearward to a generally horizontal orientation.

Those skilled in the art will recognize that the sleeves 134 could be disconnected from the foot supporting links 170 instead of the rods 132, especially on a machine having a fixed crank radius (or the connector links could be disconnected from the foot supporting links on a machine like that shown in FIG. 1 of the patent application incorporated herein by reference). Those skilled in the art will also recognize that a universal joint could be provided between the frame and the rear support as another design option.

In its storage configuration, the apparatus 100 extends a height H above a floor surface 99. When the apparatus 100 is provided with components (bars 132, pulley 140, flywheel 146, and support 122) having a thickness of one inch and spaced one-half inch apart from each other (and the floor surface 99 in the case of one of the bars 132), the height H is approximately seven and one-half inches. Recognizing that the height E is independent of the crank radius and the flywheel radius, neither stride length nor inertia need be sacrificed in the interest of collapsibility. For example, the preferred embodiment 100 is provided with a ten inch diameter flywheel and cranks that define a maximum diameter of twenty inches. The collapsed machine 100 may be described as lying entirely beneath a horizontal plane disposed ten inches or "one flywheel diameter" above the floor surface 99. In the event that the height H places a person's feet too close together for exercise purposes, spacers may be disposed between the cranks and the foot supporting links, and/or the foot supporting links may extend away from the cranks in divergent fashion.

The present invention may also be described in terms of various methods. For example, the exercise apparatus 100 is made by mounting a support on a frame so that it selectively rotates relative thereto about a first axis; mounting a crank on the support so that it rotates relative thereto about a second axis which extends generally perpendicular to the first axis; movably interconnecting a foot supporting link between the crank and the frame so that it links a striding motion to rotation of the crank; and connecting a resistance device to the crank and operable so that it resists rotation thereof relative to the frame. Moreover, the exercise apparatus 100 is transformed into a storage configuration by disconnecting the foot supporting links from the cranks; pivoting the rearward support, together with the cranks and the flywheel, to one side; and pivoting the forward support to the rear.

The present invention may be described with reference to additional collapsing exercise apparatus and methods. For example, similar linkage assemblies may be arranged in such a manner that, when in an operative configuration, the crank axis is disposed above the flywheel axis, and when in a storage configuration, the crank axis is disposed at or below the flywheel axis. In particular, such an exercise apparatus may be transformed into a storage configuration by pivoting the crank axis (and cranks) about the flywheel axis. Because the distance between the crank and the flywheel remains unchanged, the belt may remain interconnected therebetween. In order to accommodate this transformation, at least one of the cranks is selectively movable into alignment with the other crank. The rearward support (for the crank) is pivoted forward, and the forward support (for the rocker links) is pivoted rearward to result in a collapsed configuration approximately equal in height to the flywheel diameter.

In yet another embodiment/method an exercise machine has a relatively large diameter flywheel which also functions as the cranks. The flywheel is supported peripherally by at least three circumferentially spaced rollers. The rollers are rotatably mounted between parallel flanges which bound opposite sides of the flywheel. Centrally located openings in the flanges allow foot supporting links to be rotatably connected to opposite sides of the flywheel at locations radially displaced from the center of the flywheel (and axially spaced about two inches apart).

Opposite, forward ends of the foot supporting links are constrained to move in reciprocating fashion relative to the frame. In particular, universal joints are provided between the foot supporting links and rocker links and between the rocker links and the frame. In a first configuration, the universal joints allow the foot supporting links to move in response to rotation of the crank/flywheel. In a second configuration, the universal joints allow the rocker links to fold toward one another.

Platforms are pivotally mounted on intermediate portions of the foot supporting links and movable relative thereto between outwardly extending, operating positions and inwardly extending, storage positions. The overall thickness of the collapsed machine is less than six inches and substantially less than the diameter of the crank/flywheel. Floor engaging rollers are rotatably mounted on the frame to facilitate movement of the apparatus. When the machine is placed in rolling contact with the floor surface, the flywheel engaging rollers (and the flywheel axis) extend generally perpendicular to the floor surface, as well as perpendicular to the axes of the floor engaging rollers.

The foregoing description sets forth only some of the numerous possible embodiments of the present invention, and those skilled in the art will likely recognize additional embodiments, modifications, and/or applications which differ from those described herein yet nonetheless fall within the scope of the present invention. Accordingly, the scope of the present invention is to be limited only to the extent of the claims which follow.

What is claimed is:

1. An exercise apparatus, comprising:

a frame designed to rest upon a floor surface;

a support;

a bolt interconnected between the frame and the support in such a manner that the support is rotatable relative thereto about a first axis;

a lock movable between a first position, interconnected between the frame and the support in a manner that prevents rotation of the support relative to the frame, and a second position, free of at least one of the frame and the support in a manner that frees the support for rotation relative to the frame;

a left crank and a right crank, each said directly mounted on the support and rotatable relative thereto about a second axis which extends generally perpendicular to the first axis;

a left foot supporting link and a right foot supporting link, each said foot supporting link movably interconnected between a respective crank and the frame in a manner that links a striding motion to rotation of each said crank; and a resistance device connected to at least one said crank and operable to resist rotation thereof relative to the frame.

2. The exercise apparatus of claim 1, wherein each said crank includes a first member and a second member which are releasably interconnected by a fastener, and each said foot supporting link is connected to a respective second member and rotates relative thereto about a respective third axis.

3. The exercise apparatus of claim 2, wherein an effective crank radius is defined between the second axis and each said third axis and is selectively adjusted by disconnecting each said fastener, moving each said second member relative to a respective first member, and reconnecting the fastener therebetween.

4. The exercise apparatus of claim 3, wherein any one of several holes in each said second member is aligned with a hole in a respective first member to receive a respective fastener.

5. The exercise apparatus of claim 2, wherein a rearward portion of each said foot supporting link is rotatably connected to a respective second member, and a forward portion of each said foot supporting link is constrained to move in reciprocating fashion relative to the frame.

6. The exercise apparatus of claim 5, wherein the forward portion of each said foot supporting link is rotatably connected to a first portion of a respective rocker link, and a second, discrete portion of each said rocker link is rotatably connected to the frame.

7. The exercise apparatus of claim 6, wherein the frame includes a base and a post, and the post is mounted on the base and selectively rotatable relative thereto about a fourth axis which extends substantially perpendicular to the first axis, and the second portion of each said rocker link is rotatably connected to the post.

8. The exercise apparatus of claim 7, further comprising a locking means for selectively locking the post in an upright position relative to the base.

9. The exercise apparatus of claim 1, further comprising a flywheel mounted on the support and rotatable relative thereto together with each said crank, wherein the flywheel defines a flywheel diameter, and the left crank and the right crank cooperate to define a crank diameter, and when each said foot supporting link is disconnected from a respective crank, the apparatus is foldable into a storage configuration which rests entirely beneath a horizontal plane disposed at a distance above the floor surface equal to the greater of the crank diameter and the flywheel diameter.

10. The exercise apparatus of claim 1, wherein the support is rotatable relative to the frame between an operative orientation, extending generally perpendicular to the floor surface, and a storage orientation, extending generally parallel to the floor surface.

11. An exercise apparatus, comprising:

a frame having a longitudinal axis designed to rest upon a floor surface;

a left crank and a right crank, each said crank mounted on the frame and rotatable relative thereto about a crank axis;

a left foot supporting link and a right foot supporting link, each said foot supporting link movably interconnected between a respective crank and the frame in a manner that links a striding motion to rotation of each said crank;

a flywheel mounted on the frame and rotatable relative thereto about a flywheel axis, wherein the flywheel and at least one said crank are interconnected by a belt and thereby constrained to rotate together, and at least one of the flywheel and the one said crank is mounted on a pivoting frame member which pivots about a longitudinally extending axis relative to the frame and between an operative position and a storage position; and a lock movable between a first position, interconnecting the frame and the frame member in a manner which maintains the frame member in the operative position, and a second position, free of at least one of the frame and the frame member to allow the frame member to pivot to the storage position.

12. The exercise apparatus of claim 11, wherein each said crank includes a first member and a second member which are releasably interconnected by a fastener, and each said foot supporting link is connected to a respective second member and rotates relative thereto about a respective third axis, and an effective crank radius is defined between the crank axis and each said third axis.

13. The exercise apparatus of claim 12, wherein the effective crank radius is selectively adjusted by disconnecting each said fastener, moving each said second member relative to a respective first member, and reconnecting the fastener therebetween.

14. The exercise apparatus of claim 12, wherein each said second member is selectively removed from a respective first member to facilitate movement of at least one of the flywheel and the at least one said crank to the storage position.

15. The exercise apparatus of claim 11, wherein a rearward portion of each said foot supporting link is rotatably connected to a respective crank, and a forward portion of each said foot supporting link is constrained to move in reciprocating fashion relative to the frame.

16. The exercise apparatus of claim 15, wherein the forward portion of each said foot supporting link is rotatably connected to a first portion of a respective rocker link, and a second, discrete portion of each said rocker link is rotatably connected to the frame.

17. The exercise apparatus of claim 16, wherein the frame includes a base and a post, and the post is mounted on the base and selectively rotatable relative thereto, and the second portion of each said rocker link is rotatably connected to the post.

18. The exercise apparatus of claim 12, wherein at least the flywheel is movable between an operative orientation, wherein the flywheel axis extends generally horizontal, and a storage orientation, wherein the flywheel axis extends generally vertical.

19. The exercise apparatus of claim 11, wherein the left crank and the right crank cooperate to define a crank diameter, and the flywheel defines a flywheel diameter, and the apparatus is foldable into a storage configuration which rests entirely beneath a horizontal plane disposed at a distance above the floor surface equal to the greater of the crank diameter and the flywheel diameter.

20. The exercise apparatus of claim 11, wherein the flywheel and each said crank remain interconnected by the belt as the crank axis pivots relative to the frame between the operative position and the storage position.

21. An exercise apparatus, comprising:

a frame designed to rest upon a floor surface;

a flywheel mounted on the frame and rotatable relative thereto about a flywheel axis and pivotal relative thereto about a pivot axis which extends perpendicular to the flywheel axis;

a left foot supporting link and a right foot supporting link, each said foot supporting link movably interconnected between the flywheel and the frame in such a manner that the flywheel rotates as a rearward portion of each said foot supporting link moves through a circular path, and a forward portion of each said foot supporting link moves through a reciprocating path; and at least one wheel rotatably mounted on the frame and rollable across a floor surface when the apparatus is transformed into a low elevation configuration, wherein the apparatus rests entirely beneath a horizontal plane disposed at a distance above the floor surface equal to the diameter of the circular path, and wherein the flywheel axis extends perpendicular to the floor surface.

* * * * *